US007404227B2

(12) United States Patent
Otsuka et al.

(10) Patent No.: US 7,404,227 B2
(45) Date of Patent: Jul. 29, 2008

(54) CLEANING SHEET

(75) Inventors: Hiroshi Otsuka, Tochigi (JP); Hiroyuki Yanagida, Tochigi (JP)

(73) Assignee: Kao Corporation, Tokyo (JP)

( * ) Notice: Subject to any disclaimer, the term of this patent is extended or adjusted under 35 U.S.C. 154(b) by 198 days.

(21) Appl. No.: 10/540,883

(22) PCT Filed: Oct. 27, 2003

(86) PCT No.: PCT/JP03/13729

§ 371 (c)(1),
(2), (4) Date: Jun. 27, 2005

(87) PCT Pub. No.: WO2004/060129

PCT Pub. Date: Jul. 22, 2004

(65) Prior Publication Data

US 2006/0117512 A1 Jun. 8, 2006

(30) Foreign Application Priority Data

Dec. 27, 2002 (JP) ..... 2002-382126

(51) Int. Cl.
*A47L 13/20* (2006.01)

(52) U.S. Cl. ..... 15/228; 15/209.1; 15/208; 15/223; 15/231

(58) Field of Classification Search ..... 15/228, 15/209.1, 208, 223, 231
See application file for complete search history.

(56) References Cited

U.S. PATENT DOCUMENTS

| | | | | |
|---|---|---|---|---|
| 3,737,938 | A | 6/1973 | Saltzstein | |
| 5,525,397 | A * | 6/1996 | Shizuno et al. | 428/138 |
| 6,047,435 | A * | 4/2000 | Suzuki et al. | 15/229.8 |
| 6,996,871 | B1 * | 2/2006 | Policicchio | 15/228 |

FOREIGN PATENT DOCUMENTS

| | | |
|---|---|---|
| JP | 7-184815 | 7/1995 |
| JP | 3027381 | 8/1996 |
| JP | 10-201692 | 8/1998 |
| JP | 3057754 | 3/1999 |
| WO | WO 9423634 A1 * | 10/1994 |
| WO | 97/35510 | 10/1997 |

* cited by examiner

*Primary Examiner*—Shay L Karls
(74) *Attorney, Agent, or Firm*—Oblon, Spivak, McClelland, Maier & Neustadt, P.C.

(57) ABSTRACT

A cleaning sheet adapted to be attached to the head (20) of a cleaning tool (2). The cleaning sheet has a wiping portion (1A) that is disposed on the bottom of the head (20) when the cleaning sheet is attached to the head (20). The cleaning sheet has projecting parts (10) and (11) in the wiping portion (1A) which stick out of the forward and backward edges of the head (20) by a projecting length M when the cleaning sheet is attached to the head (20). The projecting parts (10) and (11) have a repulsive force of 0.1 to 100 N/cm when deformed by a length M/3 in the direction opposite the projecting direction. The projection (10) preferably has pointed tips.

16 Claims, 9 Drawing Sheets

CLEANING SHEET

TECHNICAL FIELD

The present invention relates to a disposable cleaning sheet that is mostly adapted to be attached to a cleaning tool and used to collect dust and debris, such as house dust.

BACKGROUND ART

A variety of cleaning tools have been proposed for cleaning the surface of furniture, walls, and floors of houses, automotive interior trim, and the like. Amongst them is a cleaning tool having a handle and a head to which a cleaning sheet made of nonwoven fabric, etc. is attached.

The outer portion of the head of this type of a cleaning tool is made of an elastic material so as not to scratch the surface to be cleaned. The sheet attached to the head is a soft sheet formed of nonwoven fabric, etc. Therefore, it is often difficult with this kind of a cleaning sheet to sufficiently catch up dust and debris such as hairs, fluffy dust, and soil dust (hereinafter inclusively referred to dust) gathering in the corners of a room by a usual wiping operation.

In order to solve the problem, a cleaning sheet having a projection sticking out of the edge of the cleaning head with which to trap dust is proposed as described in Japanese Utility Model 3027381. Merely having a projection, the proposed cleaning sheet is not sufficiently effective in collecting dust.

An object of the present invention is to provide a cleaning sheet capable of surely collecting and trapping dust from a corner.

DISCLOSURE OF THE INVENTION

The present inventors have investigated capabilities of a cleaning sheet in collecting dust from a corner. They have found as a result that the shape and the repulsive force of the fringe around a wiping portion, which is adapted to be disposed on the bottom of the head, of a cleaning sheet are important and thus reached the present invention.

The present invention has been completed based on the above finding. It provides a cleaning sheet adapted to be attached to the head of a cleaning tool. The cleaning sheet has a projecting part in the wiping portion thereof that is adapted to be disposed on the bottom of the head. When the cleaning sheet is attached to the head, the projecting part sticks out of the edge of the head by a projecting length M, and the projecting part has a repulsive force of 0.1 to 100 N/cm when deformed by a length M/3 in the direction opposite the projecting direction.

BEST MODE FOR CARRYING OUT THE INVENTION

The present invention will be described based on its preferred embodiments with reference to the accompanying drawings.

Figure 1:
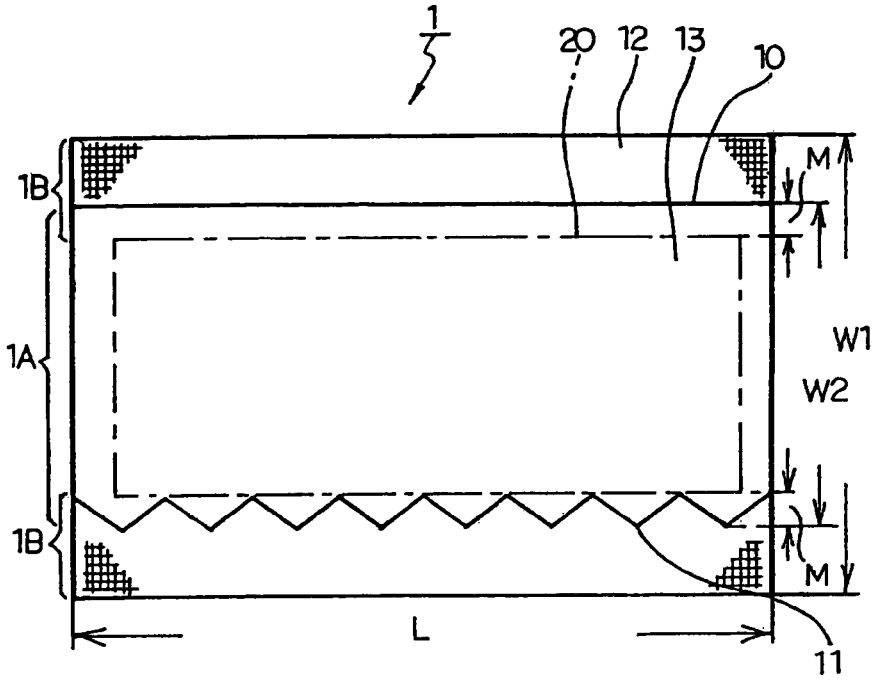
FIG. 1 is a schematic plan of a cleaning sheet according to an embodiment of the present invention.
Figure 2:
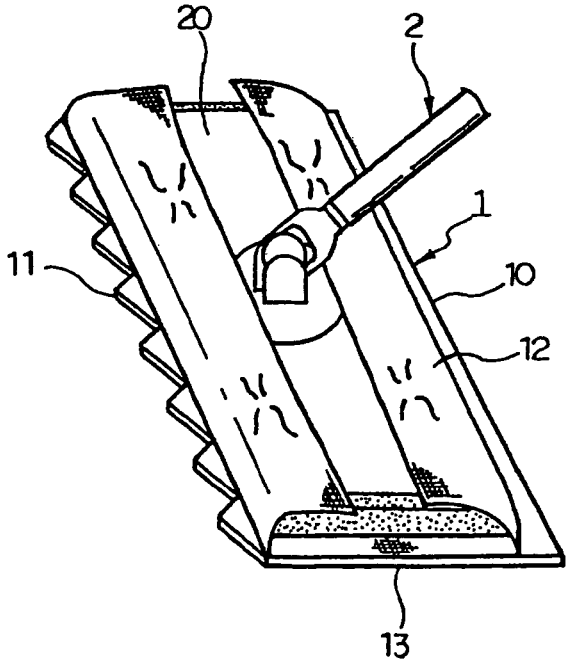
FIG. 2 is a schematic perspective of the cleaning sheet of FIG. 1 attached to the head of a cleaning tool.

FIGS. 1 and 2 show a cleaning sheet according to an embodiment of the present invention. FIG. 2 illustrates the cleaning sheet attached to the head of a cleaning tool. In FIGS. 1 and 2 numerals 1 and 2 indicate a cleaning sheet and a cleaning tool, respectively. The dashed line in FIG. 1 indicates the position of the head 20.

As shown in FIG. 1, the cleaning sheet 1 is substantially rectangular in its plan view. The cleaning sheet 1 has a wiping portion 1A and fixing portions 1B provided on both sides of the wiping portion 1A. When the cleaning sheet 1 is attached to the plate-like head 20 of the cleaning tool 2 as shown in FIG. 2, the wiping portion 1A is disposed on the bottom side of the head 20, and the fixing portions 1B are fastened to the upper side of the head 20.

While the cleaning sheet 1 is not particularly limited in size and shape, it is preferred that both length L and width W2 fall within +30% of the length and the width, respectively, of the bottom of the head 20 of the cleaning tool 2. As the area of the head 20 of the cleaning tool 2 increases, the wiping portion 1A of the cleaning sheet 1 should have an accordingly increased area. For general domestic applications, the length L is preferably 170 to 340 mm, and the width W2 of the wiping portion 1A is preferably 70 to 230 mm. The area of the wiping portion 1A is preferably 120 to 780 $cm^2$.

The cleaning sheet 1 has projecting parts 10 and 11 that stick out of the forward and backward edges of the head 20. The projecting parts 10 and 11 each have a repulsive force of 0.1 to 100 N/cm, preferably 0.2 to 50 N/cm, more preferably 0.3 to 10 N/cm, when deformed by ⅓ in the direction opposite the projecting direction. If the repulsive force of the projecting parts 10 and 11 is less than 0.1 N/cm, it is difficult for the projecting parts to catch up dust because of small sweeping pressure, and sufficient cleaning effects are not obtained. If the repulsive force exceeds 100 N/cm, the projecting parts can damage the surface to be cleaned.

The repulsive force of the projecting part of the cleaning sheet is measured with CPU Gauge 9500 (available from Aikoh Engineering Corp.; rated capacity: 2 kgf; A type) as follows. The cleaning sheet is attached around a plate having the same size and shape as the head of the cleaning tool. The projecting part is pressed by the 10 mm wide terminal of the gauge in the direction opposite the projecting direction. The value read when the projecting part is deformed by one-third of its length in that direction is taken as a repulsive force (N) per width of the terminal (1 cm).

The projecting parts 10 and 11 preferably stick out 1 to 50 mm, more preferably 3 to 30 mm, (i.e., projecting length M) from the respective edges of the head 20 (from the forward and the backward ends in this embodiment). With a too short projecting length, the projecting part fails to exhibit sufficient sweeping function, and the wiping portion 1A has a small area, which may result in reduced dust collecting capacity. Too long a projecting length M results in a reduced repulsive force and can result in reduction of the cleaning effect of the projecting parts 10 and 11.

In the present embodiment, the projecting part 10 has a straight edge, while the projecting part 11 has a zigzag edge like a mountain chain. The number of teeth (the number of mountains) of the zigzag edge can be adjusted according to the base length and pitch of the teeth, etc.

As shown in FIG. 1, the cleaning sheet 1 of the present embodiment is basically composed of a base sheet 12 and a wiping sheet 13 that is fixed by adhesion to almost the middle region of the base sheet 12. The projecting parts 10 and 11 are provided as a fringe of the forward and backward sides of the wiping sheet 13.

The base sheet 12 is not particularly limited in shape and material as long as it is attachable to the head 20. Taking into consideration ease of attaching to the head 20, capability of continuing being attached to the head 20, stiffness, and like properties of the cleaning sheet 1, preferred sheets as the base sheet 12 include fabric (either nonwoven or woven), paper, synthetic resin-containing paper, elastic sheets, and a synthetic resin sheet having an adhesive layer. Where a sheet having an adhesive layer on the area corresponding to the wiping portion 1A is used, the wiping sheet 13 can be adhered and fixed thereon.

The base sheet 12 preferably has a basis weight of 5 to 100 $g/m^2$ from the viewpoint of operationality, fabricability, stiffness, and flexibility. The base sheet 12 preferably has a thickness of 0.005 to 3 mm from the standpoint of operationality, fabricability, stiffness, and flexibility.

The wiping sheet 13 can be of any material that has been used in cleaning sheets designed to catch up dust by entanglement or adsorption. For example, paper (including synthetic resin-containing paper), fabric (nonwoven or woven), film or pile fabric can be used. In addition, the cleaning sheet described in JP-A-7-184815, paragraphs [0008] to [0018] is also useful. The wiping sheet 13 may be one impregnated with a liquid containing at least one of oils, such as mineral oils, synthetic oils, and silicone oils, and surface active agents to develop adsorptivity for dust.

The wiping sheet 13 preferably has a basis weight of 20 to 400 $g/m^2$ from the viewpoint of operationality, fabricability, stiffness, and flexibility. From the same viewpoint, the wiping sheet 13 preferably has a thickness of 0.5 to 10 mm.

The projecting parts 10 and 11 in the fringe of the wiping sheet 13 can be provided with the above-specified repulsive force by any method, for example, thickening the projecting parts, raising or indenting the surface of the projecting parts by embossing or molding, increasing the basis weight of the projecting parts, or reinforcing the projecting parts with another material superposed on the upper side of the wiping sheet 13 in the area corresponding to the projecting parts. In this way, the specific repulsive force required for performing the sweeping function can be imparted to the projecting parts 10 and 11 without impairing the dust collecting capabilities of the lower side of the projecting parts.

The cleaning sheet 1 is attached to the head 20 and used in a usual manner of wiping. It is capable of collecting and trapping dust, such as hairs, fluffy dust or soil dust, through entanglement with or adsorption onto the fibers of its wiping portion 1A. In particular, although the peripheral portion of the head 20 is made of an elastic material, the cleaning sheet 1 is capable of sweeping dust gathering, e.g., in a corner of a room with its projecting parts 10 and 11 having the desired repulsive force and then trapping the dust. This function can be accomplished without impairing the dust collecting capabilities of the lower side of the wiping sheet 13. Because the projecting parts 10 and 11 are differently shaped, a user can choose whichever projecting part fit for the shape of the corner to be cleaned and suitable to sweep the dust from the corner.

FIGS. 3 through 7 depict other embodiments of the present invention. In these figures, the same members as used in the cleaning sheet 1 are given the same reference numerals as in the cleaning sheet 1, and the description therefor will be omitted. With respect to those particulars which are not explained hereunder, the description on the cleaning sheet 1 applies accordingly.

Figure 3:
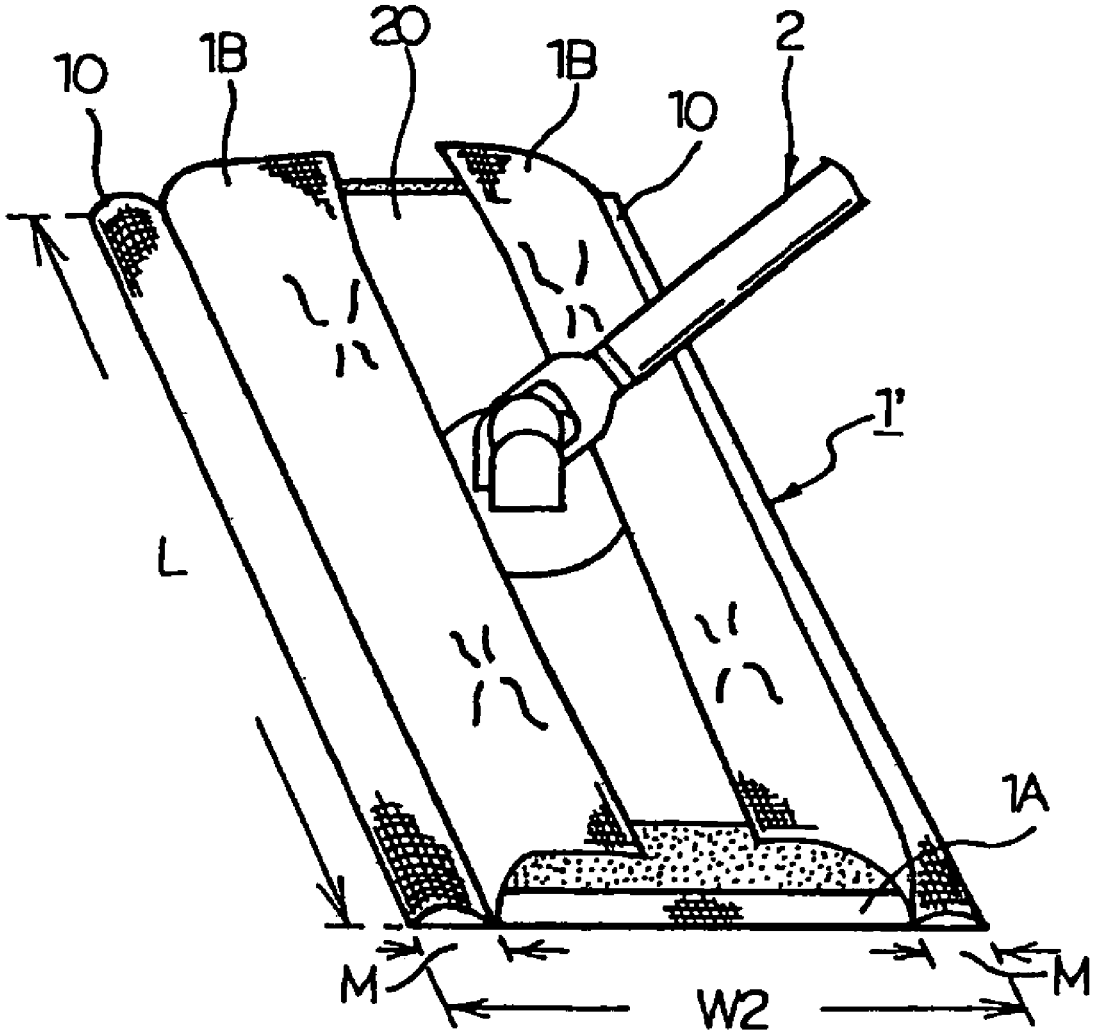
FIG. 3 is a schematic perspective of a cleaning sheet according to another embodiment of the present invention attached to the head of a cleaning tool.

The cleaning sheet 1', of the embodiment shown in FIG. 3 is composed solely of a wiping sheet. The wiping sheet 13 has pleat-shaped projections 10 each having the above-specified repulsive force and being adapted to stick out of the edges of the head 20 (the forward and backward edges in the embodiment shown in FIG. 3) with a predetermined projecting length M. The pleat-shaped projections 10 are formed by folding back the wiping sheet 13 and fixing the folds by heat sealing or sewing or with an adhesive or a like means. In this embodiment, the projecting parts 10 are formed by folding back the wiping sheet 13 toward the same side (either the surface side or the reverse side). The cleaning sheet 1' of this embodiment not only produces the same effects as by the cleaning sheet 1 but achieves material and production cost saving. The repulsive force can easily be adjusted by the position to fold back.

Figure 4A:
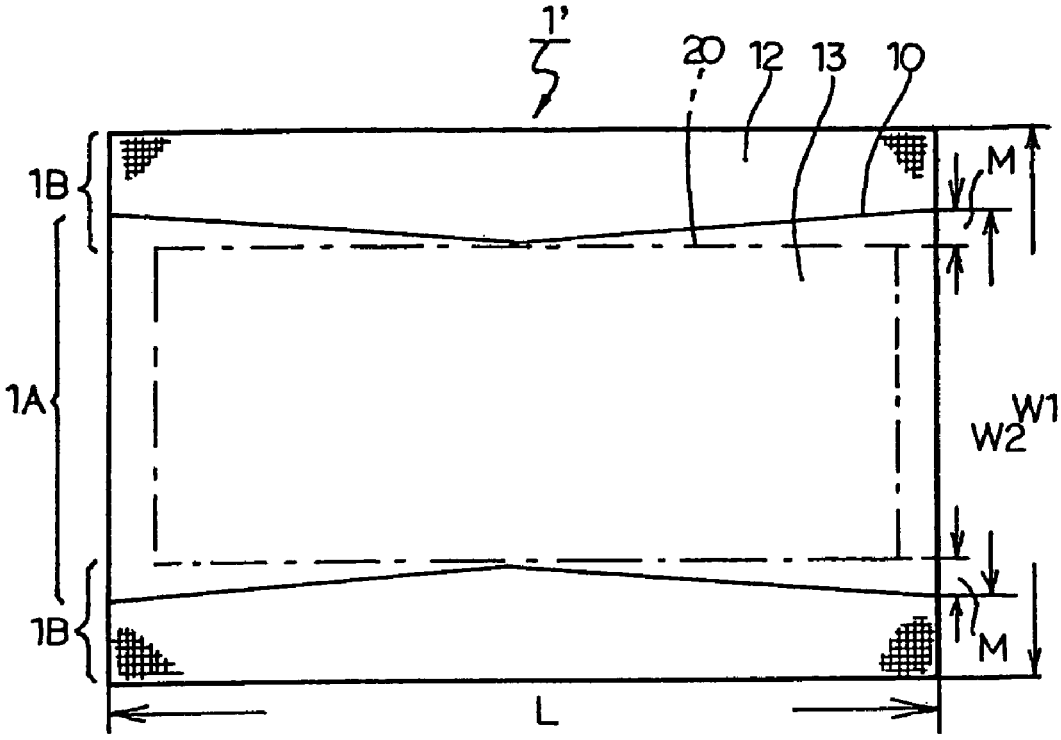
FIG. 4(*a*) and FIG. 4(*b*) are each a schematic plan (corresponding to FIG. 1) of a cleaning sheet according to still another embodiment of the present invention.
Figure 4B:
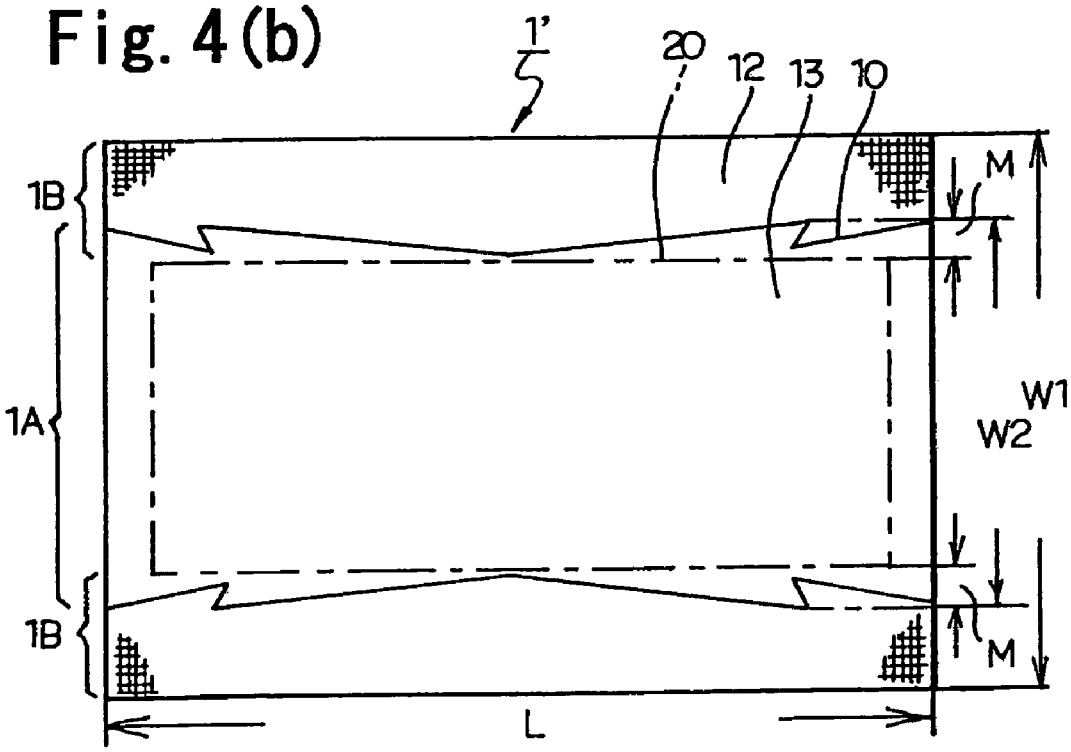
Figure 5A:
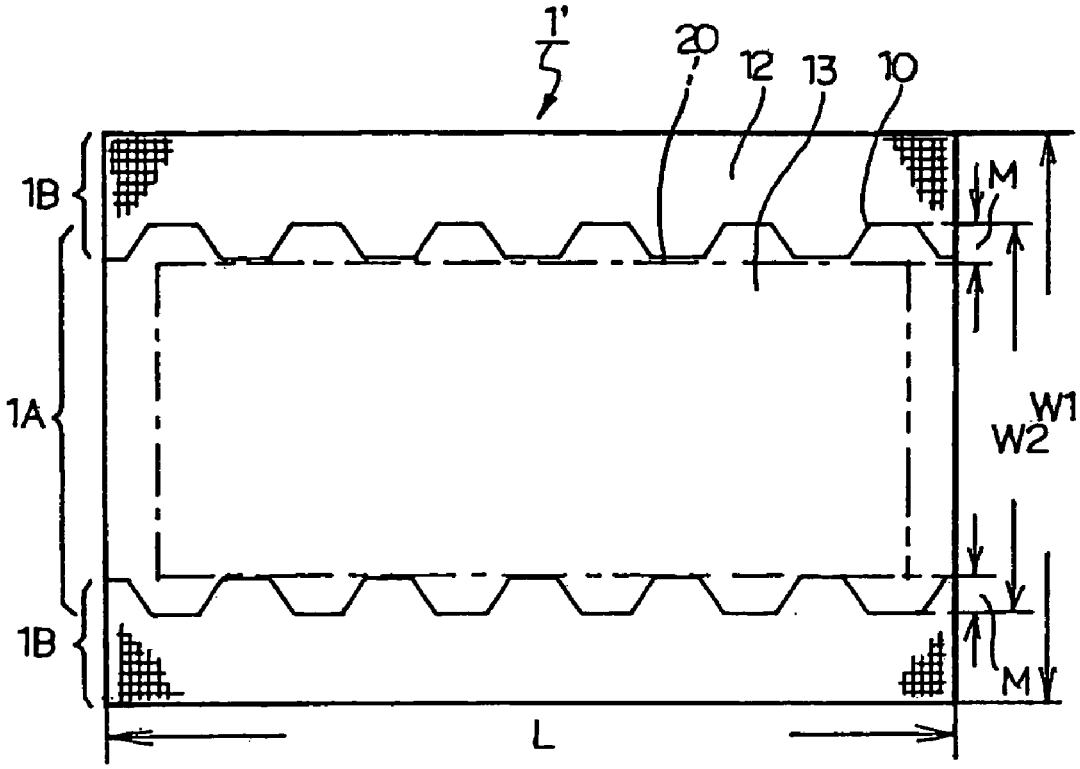
FIG. 5(*a*) and FIG. 5(*b*) are each a schematic plan (corresponding to FIG. 1) of a cleaning sheet according to still another embodiment of the present invention.
Figure 5B:
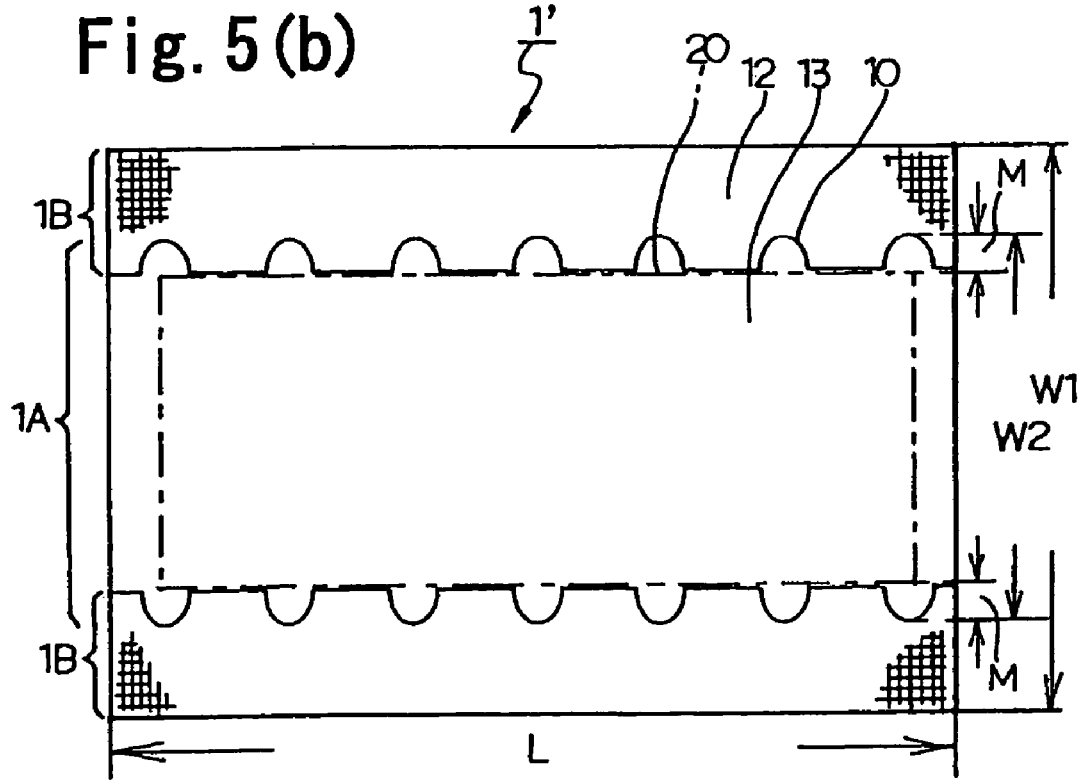

FIGS. 4(*a*), 4(*b*), 5(*a*), and 5(*b*) show modifications to the shape of the projecting parts of the cleaning sheet 1'. The projecting parts of the cleaning sheet 1' shown in FIGS. 4(*a*) and 4(*b*) are wedge-shaped fringes whose edges slope upward from the widthwise middle in the left and right directions of the sheet 1'. The projecting parts of the cleaning sheet 1' shown in FIGS. 5(*a*) and 5(*b*) are discontinuous arrays of polygonal(e.g., trapezoidal or rectangular) or semi-circular projections. These cleaning sheets 1' are effective similarly to the above-described cleaning sheet 1. The shape of the projecting parts can be chosen according to the object to be cleaned.

Figure 6:
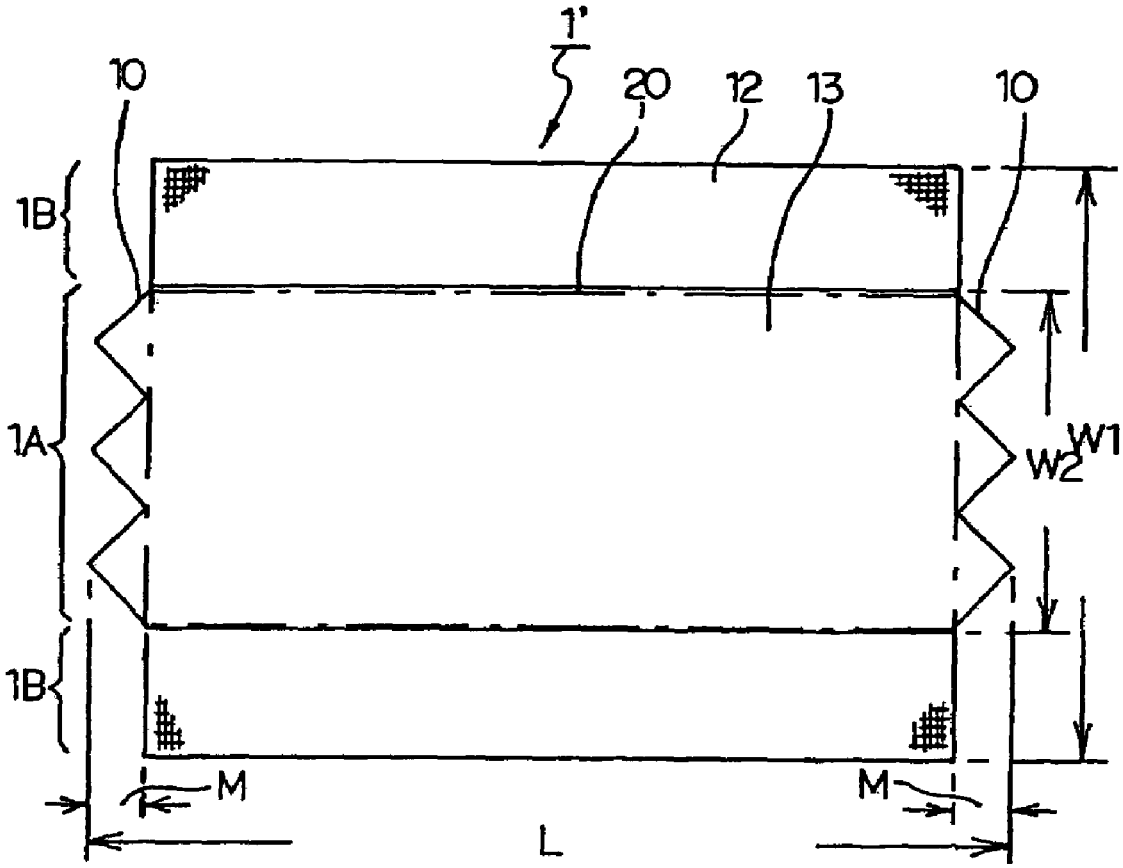
FIG. 6 is a schematic plan (corresponding to FIG. 1) of a cleaning sheet according to still another embodiment of the present invention.

FIG. 6 shows a cleaning sheet 1' having projecting parts 10 sticking out of the left and right short side edges of the head 20 (in the sheet length L direction). The cleaning sheet 1' according to this embodiment produces the same effects as by the cleaning sheet 1.

Figure 7:
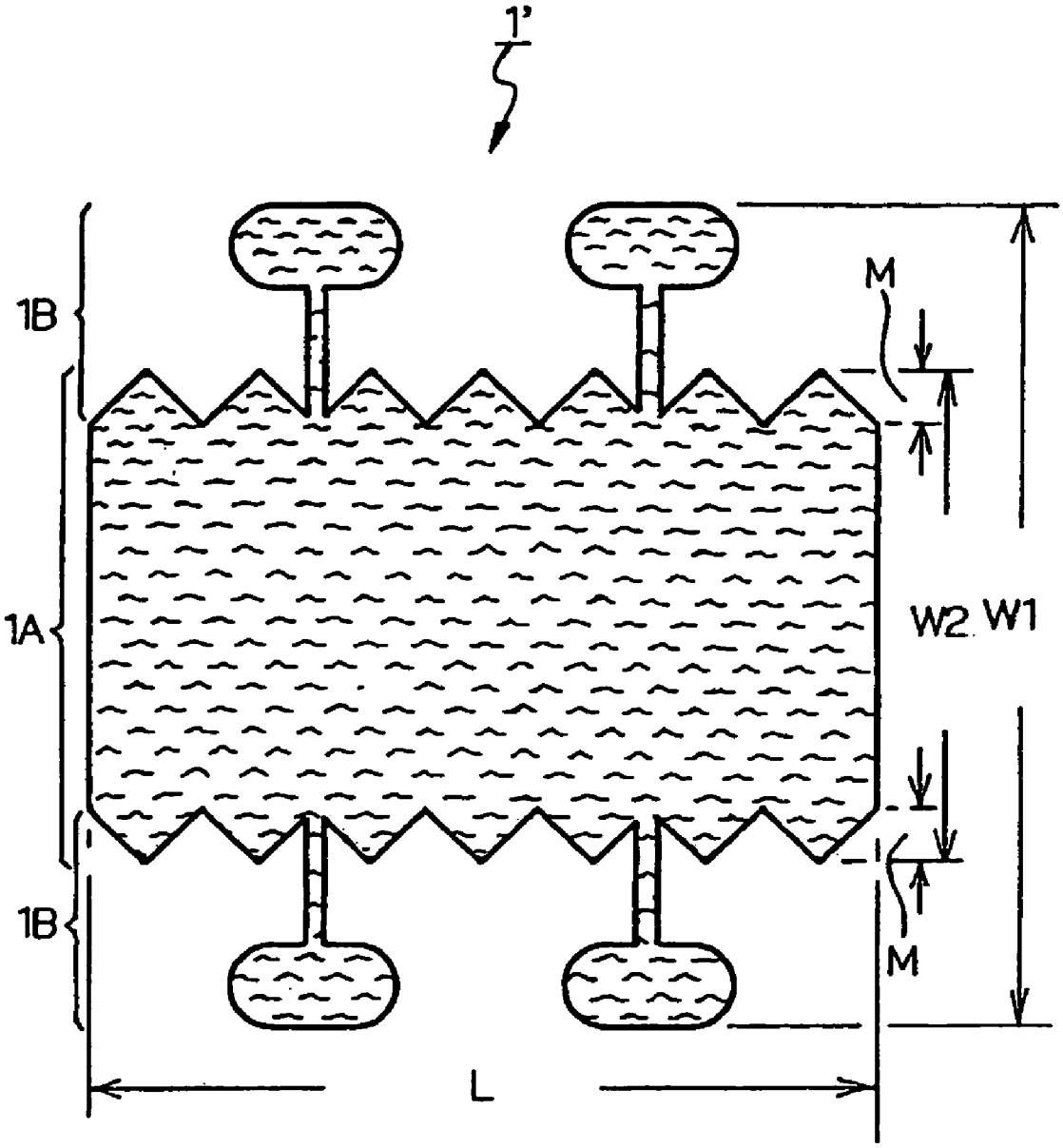
FIG. 7 is a schematic plan (corresponding to FIG. 1) of a cleaning sheet according to still another embodiment of the present invention.
Figure 8:
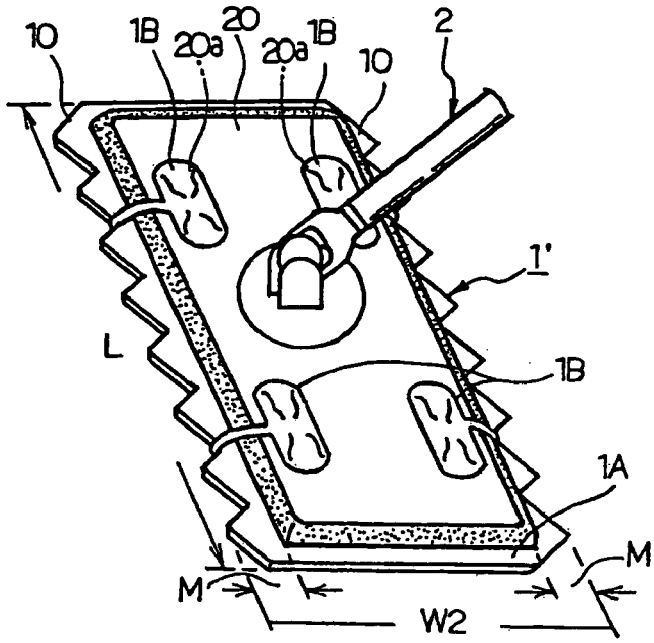
FIG. 8 is a schematic perspective of a cleaning sheet according to still another embodiment of the present invention attached to the head of a cleaning tool.

FIGS. 7 and 8 show a cleaning sheet 1' having fixing portions 1B which extend from the forward and backward edges of the projecting parts 10 to the respective fastening members 20*a* of the head 20 of the cleaning tool 2. The cleaning sheet 1' according to this embodiment not only produces the same effects as by the cleaning sheet 1 but leads to a great saving of the base sheet, which results in reduction of production cost. In addition, the cleaning sheet 1' is reversibly usable.

The present invention is by no means limited to the aforementioned embodiments, and various changes and modifications can be made therein without departing from the spirit and scope thereof.

The cleaning sheet of the present invention preferably has such a structure that the wiping sheet 13 is fixedly superposed on the surface side of the base sheet 12 like the cleaning sheet 1 according to the aforementioned embodiment. It is also possible that the wiping sheet 13 is fixedly superposed on both sides of the base sheet 12 to make a reversible cleaning sheet.

While the cleaning sheet of the present invention preferably has the projecting part on both the forward and the backward edges as in the cleaning sheet 1 of the above-described embodiment, the projecting part may be provided on only one of the forward and backward edges, or the projecting part may be provided on only one of the left and right side edges. It is also possible for the cleaning sheet to have the projecting part on both the forward and backward edges or both the left and right side edges.

The configuration of the projecting parts can be altered appropriately as long as the above-specified repulsive force can be secured.

Figure 9:
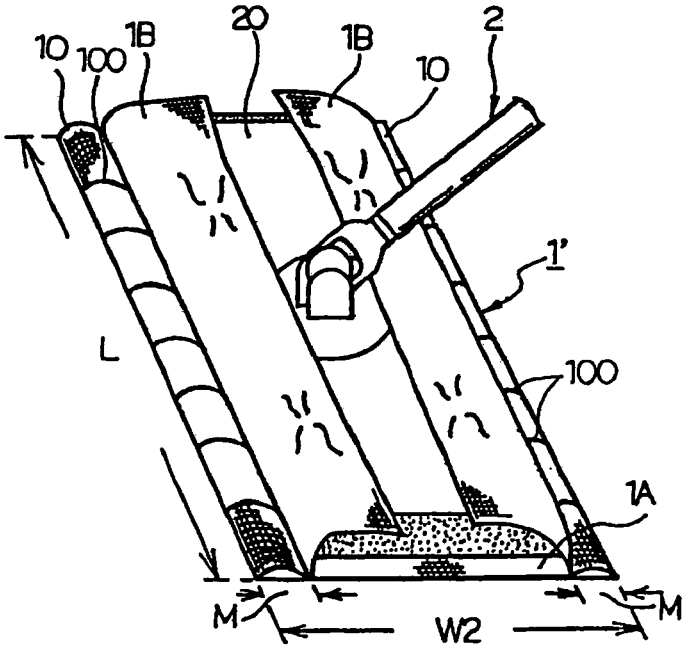
FIG. 9 is a schematic perspective of a cleaning sheet according to still another embodiment of the present invention attached to the head of a cleaning tool.
Figure 10:
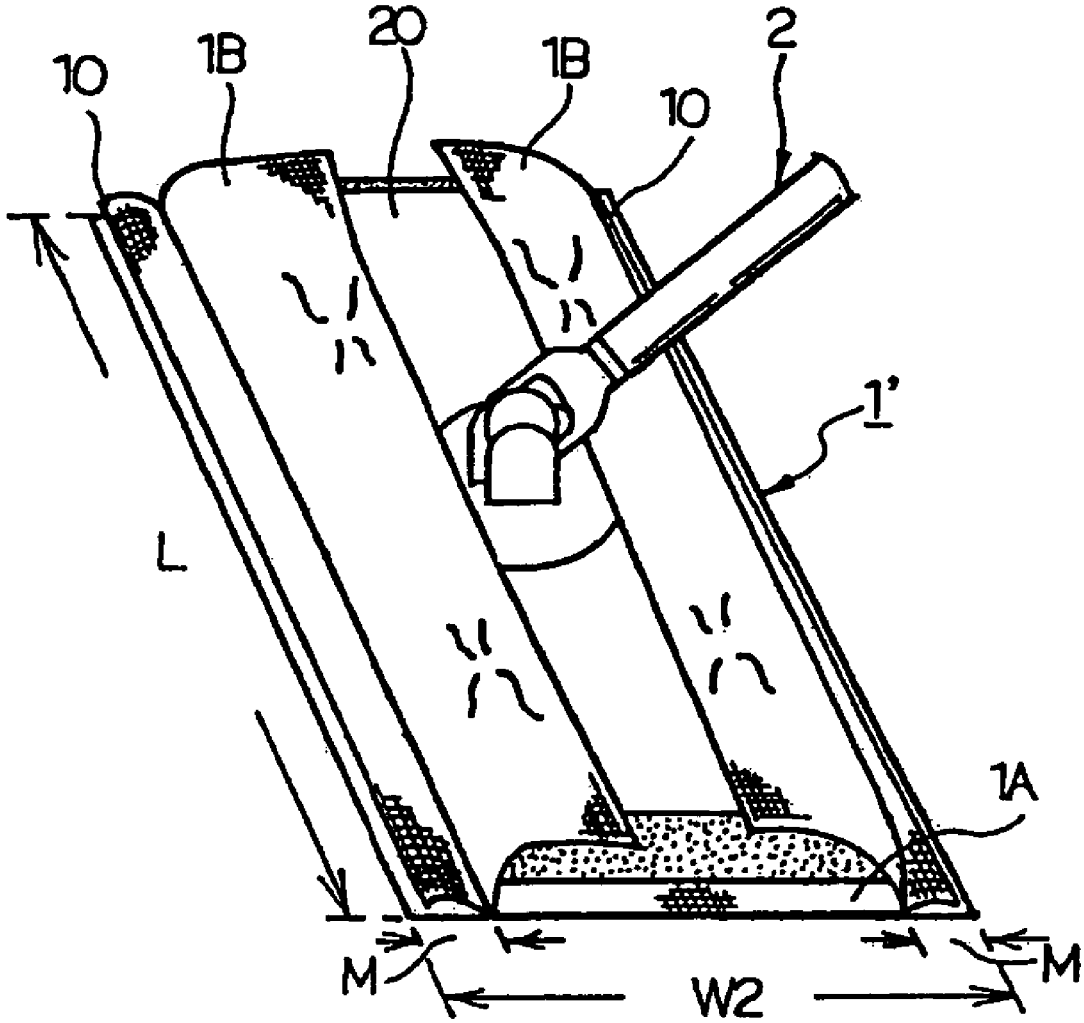
FIG. 10 is a schematic perspective of a cleaning sheet according to yet another embodiment of the present invention attached to the head of a cleaning tool.

For example, the projecting parts that are continuous in the longitudinal direction of the wiping sheet 13 as in the cleaning sheet 1' of the embodiment shown in FIG. 3 may be made discontinuous by making slits 100 at a regular interval in the transverse direction as illustrated in FIG. 9 or making cutouts to a desired shape (e.g., a mountain shape or a rectangular shape). As shown in FIG. 10, the looped folds of the wiping sheet 13 can be slit in the sheet length direction to make projecting parts 10 open toward the respective projecting directions. The above-described discontinuous configuration and open configuration may be used in combination. If desired, the cleaning sheet may have a plurality of pleat-shaped projecting parts formed by folding back repeatedly, or may have a projecting part projecting from only the left and right side edges of the head, or may have a projecting part projecting from each of the four edges of the head.

Figure 11A:
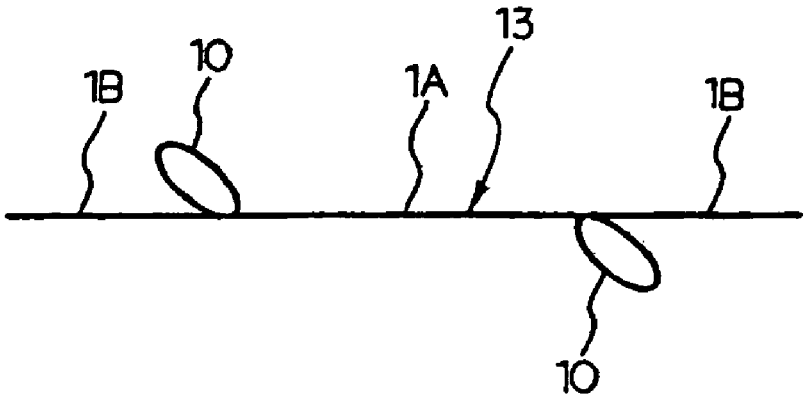
FIG. 11(*a*), FIG. 11(*b*), and FIG. 11(*c*) each schematically illustrate the way of folding back a wiping sheet to make projecting parts of a cleaning sheet according to the present invention, in which FIG. 11(*a*) shows the way of pleating the wiping sheet on the surface side and the reverse side, FIG. 11(*b*) shows the way of pleating the wiping sheet on the same side to make pleat-shaped projecting parts, and FIG. 11(*c*) shows the way of pleating the wiping sheet on the surface side and the reverse side to make pleat-shaped projecting parts.
Figure 11B:
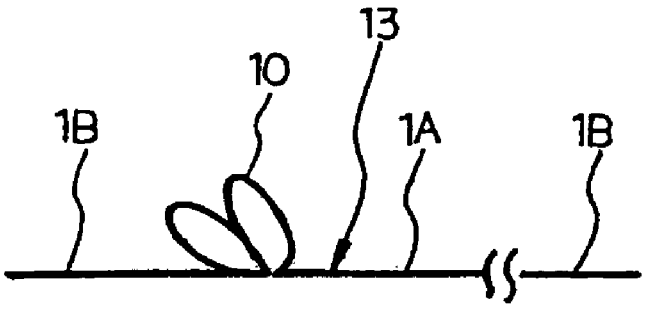
Figure 11C:
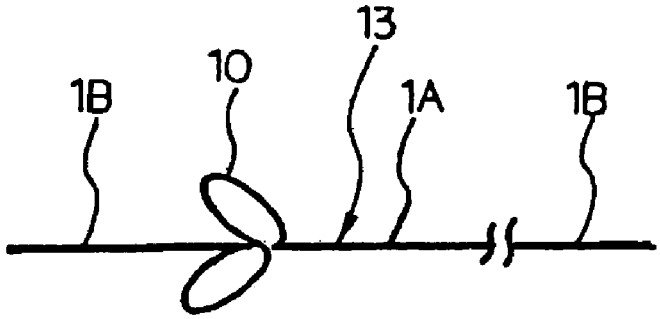

The manner of folding back for making a pleat-shaped projecting part is not particularly restricted. For example, the wiping sheet 13 can be folded back to the surface side and the reverse side to form the respective projecting parts 10, which provides a reversible sheet, as shown in FIG. 11(*a*). Where the wiping sheet is folded back repeatedly, it may be folded back to the same side to make projecting parts 10 on the same side as shown in FIG. 11(*b*), or the sheet may be folded back to different sides to make a projecting part 10 on each side thereof.

The method of fixing the wiping sheet to the base sheet is not particularly limited. For example, the fixing can be performed by adhesion as in the case of the cleaning sheet 1 of the aforementioned embodiment, heat sealing, sewing, and the like.

The form and material of the fixing portions of the cleaning sheet are not limited and can be altered appropriately according to the shape of the cleaning tool's head.

INDUSTRIAL APPLICABILITY

The present invention provides a cleaning sheet with which dust can surely be swept, collected, and trapped from a corner.

The invention claimed is:

1. A cleaning sheet adapted to be attached to a head of a cleaning tool and comprising:

a base sheet having a first length and first width; and a first wiping sheet having a second length and second width, as measured parallel to the first length and width, respectively, the first wiping sheet being disposed on one side of the base sheet, the first wiping sheet including a wiping portion adapted to be disposed on the head facing away from the head, and a first projecting part with a first edge and including a part of the wiping portion, which is reinforced with another material superimposed on the first wiping sheet in an area corresponding to the first projecting part, a second projecting part with a second edge and including a second part of the wiping portion, the second projecting part extending outward from an edge of the head, the second edge having a different shape from the first edge, the first projecting part being adapted to extend outward from an edge of the head by a projecting length M when the cleaning sheet is attached to the head on an opposite side of the head from which the second projecting part extends, and the first projecting part having a repulsive force of 0.1 to 100 N/cm when deformed by a length M/3 in the direction opposite the projecting direction thereof, the base sheet overlapping the first wiping sheet along the first length and first width such that the first width is larger than the second width, and portion of the base sheet extending beyond the second width of the first wiping sheet is configured to fold around the head of the cleaning tool independently of the first wiping sheet.

2. The cleaning sheet according to claim 1, wherein the first wiping sheet is disposed on the surface of the base sheet and the projecting part is a first fringe of the first wiping sheet.

3. The cleaning sheet according to claim 2, further comprising a second wiping sheet disposed on a side of the base sheet opposite the first wiping sheet.

4. The cleaning sheet according to claim 3, wherein the base sheet comprises a different material than material comprising the first and second wiping sheets.

5. The cleaning sheet according to claim 4, wherein the second wiping sheet includes a second fringe.

6. The cleaning sheet according to claim 5, wherein the first and second fringes are sections of the first and second wiping sheets, respectively.

7. The cleaning sheet according to claim 1, wherein the repulsive force is from 0.2 to 50 N/cm when deformed by a length M/3 in the direction opposite the projecting direction thereof.

8. The cleaning sheet according to claim 1, wherein the repulsive force is from 0.3 to 10 N/cm when deformed by a length M/3 in the direction opposite the projecting direction thereof.

9. The cleaning sheet according to claim 1, wherein the projecting part is an edge of the first wiping sheet.

10. The cleaning sheet according to claim 1, wherein the cleaning sheet is adapted to connect to the head of the cleaning tool with the base sheet disposed between the first wiping sheet and the head.

11. The cleaning sheet according to claim 1, wherein the first and second lengths are equal.

12. The cleaning sheet according to claim 1, wherein the first and second projecting parts are integral continuations of the edges of the first wiping sheet.

13. The cleaning sheet according to claim 1, wherein the first projecting part extends away from the head in a first direction while the head is moved in the first direction.

14. The cleaning sheet according to claim 13, wherein the second projecting part extends away from the head in a second direction while the head is moved in the second direction.

15. The cleaning sheet according to claim 1, wherein the first projecting part has a zigzag shaped leading edge across the second length, and the second projecting part has a straight leading edge across an entire length of the second projecting part.

16. The cleaning sheet according to claim 1, wherein the head has a third length and third width, and the second width is greater than the third width.

* * * * *